US012220094B1

(12) United States Patent
Elstone, Jr.

(10) Patent No.: US 12,220,094 B1
(45) Date of Patent: Feb. 11, 2025

(54) BACKPACK DECONTAMINATION SHOWER SHELTER

(71) Applicant: Paul J. Elstone, Jr., Burlington, NJ (US)

(72) Inventor: Paul J. Elstone, Jr., Burlington, NJ (US)

( * ) Notice: Subject to any disclaimer, the term of this patent is extended or adjusted under 35 U.S.C. 154(b) by 0 days.

(21) Appl. No.: 18/680,619

(22) Filed: May 31, 2024

(51) Int. Cl.

| | |
|---|---|
| ***A47K 3/28*** | (2006.01) |
| ***A45F 3/04*** | (2006.01) |
| ***A47K 3/32*** | (2006.01) |
| ***E04H 1/12*** | (2006.01) |

(52) U.S. Cl.
CPC ..... *A47K 3/286* (2013.01); *A45F 3/04* (2013.01); *A47K 3/325* (2013.01); *E04H 1/1277* (2013.01)

(58) Field of Classification Search
CPC .. A47K 3/286; A47K 3/288; A47K 3/32–325; B60P 3/005; E04H 1/1277; E04H 1/1244; E04H 4/0025; E04H 4/144; A61G 25/145; A63H 23/16; B05B 9/0888
See application file for complete search history.

(56) References Cited

U.S. PATENT DOCUMENTS

| | | | | | |
|---|---|---|---|---|---|
| 2,840,828 | A * | 7/1958 | Furnberg | E04H 4/0025 | 417/92 |
| 3,067,434 | A * | 12/1962 | Neal | A47K 3/325 | 4/598 |
| 4,539,720 | A * | 9/1985 | Westerweller | A47K 3/325 | 4/596 |
| 5,311,620 | A * | 5/1994 | Ratje | A47K 3/325 | 4/603 |
| 5,911,520 | A * | 6/1999 | Kenney | A47K 3/285 | 4/603 |
| 6,192,633 | B1 * | 2/2001 | Hilbert | E04H 15/20 | 52/87 |
| 6,220,828 | B1 * | 4/2001 | Lau | F04D 25/04 | 4/492 |
| 6,981,613 | B1 * | 1/2006 | Kamisugi | B05B 1/205 | 222/93 |
| 9,458,641 | B2 * | 10/2016 | Harlow | E04H 1/1277 | |
| 2018/0104710 | A1 * | 4/2018 | Cabral | A01M 7/0017 | |

FOREIGN PATENT DOCUMENTS

| | | | | |
|---|---|---|---|---|
| CN | 112361518 | * | 2/2021 | E04H 1/1277 |
| DE | 202007000811 | * | 3/2007 | A47K 3/325 |
| GB | 2323395 | * | 9/1998 | E04H 1/1277 |
| GB | 2355184 | * | 4/2001 | A47K 3/32 |

* cited by examiner

*Primary Examiner* — David P Angwin
*Assistant Examiner* — Nicholas A Ros
(74) *Attorney, Agent, or Firm* — Walter J. Tencza, Jr.

(57) ABSTRACT

An apparatus including an inflatable tube assembly; a shower assembly; configured to be attached to the inflatable tube assembly when the inflatable tube assembly is in an inflated state; a canopy configured to cover the inflatable tube assembly, when the inflatable tube assembly is in the inflated state; a first bottle for inflating the inflatable tube assembly; and a backpack configured to hold the inflatable tube assembly in a deflated state, simultaneously the first bottle. The apparatus may further include a second bottle; wherein the backpack is configured to hold a second bottle, simultaneously with the first bottle and the inflatable tube assembly in the deflated state; and wherein the second bottle includes a decontamination material. The apparatus may further include a third bottle, wherein the third bottle is a water bottle; and wherein the water bottle is configured to supply water to the shower assembly.

15 Claims, 13 Drawing Sheets

BACKPACK DECONTAMINATION SHOWER SHELTER

FIELD OF THE INVENTION

This invention relates to devices used for shelter, such as tents.

BACKGROUND OF THE INVENTION

There are various known shelter devices known in the art, including various types of tents.

SUMMARY OF THE INVENTION

In at least one embodiment, an apparatus is provided comprising: an inflatable tube assembly; a shower assembly; configured to be attached to the inflatable tube assembly when the inflatable tube assembly is in an inflated state; a canopy configured to cover the inflatable tube assembly, when the inflatable tube assembly is in the inflated state; a first bottle for inflating the inflatable tube assembly; and a backpack configured to hold the inflatable tube assembly in a deflated state, simultaneously the first bottle.

The apparatus may further include a second bottle; wherein the backpack is configured to hold a second bottle, simultaneously with the first bottle and the inflatable tube assembly in the deflated state; and wherein the second bottle includes a decontamination material.

The apparatus may further include a third bottle, wherein the third bottle is a water bottle; and wherein the water bottle is configured to supply water to the shower assembly.

In at least one embodiment, the first bottle may be an air bottle and may be configured to force water from the third bottle to be supplied to the shower assembly.

In at least one embodiment of the present invention, an method is provided which may include inflating an inflatable tube assembly by using a first bottle; attaching a shower assembly to the inflatable tube assembly when the inflatable tube assembly is in the inflated state; and covering the inflatable tube assembly with a canopy, when the inflatable tube assembly is in the inflated state.

The method may further include removing the inflatable tube assembly from a backpack, when the inflatable tube assembly is in a deflated state, and prior to inflating the inflatable tube assembly.

The method may further include removing the first bottle from the backpack prior to inflating the inflatable tube assembly. The method may further include removing a second bottle from the backpack prior to inflating the inflatable tube assembly, and using the second bottle to supply water to the shower assembly after the shower assembly is attached to the inflatable tube assembly when the inflatable tube assembly is in the inflated state.

The method may further include removing the first bottle from the backpack prior to inflating and using the first bottle to force water from the second bottle to be supplied to the shower assembly after the shower assembly is attached to the inflatable tube assembly when the inflatable tube assembly is in the inflated state.

DETAILED DESCRIPTION OF THE DRAWINGS

Figure 1:
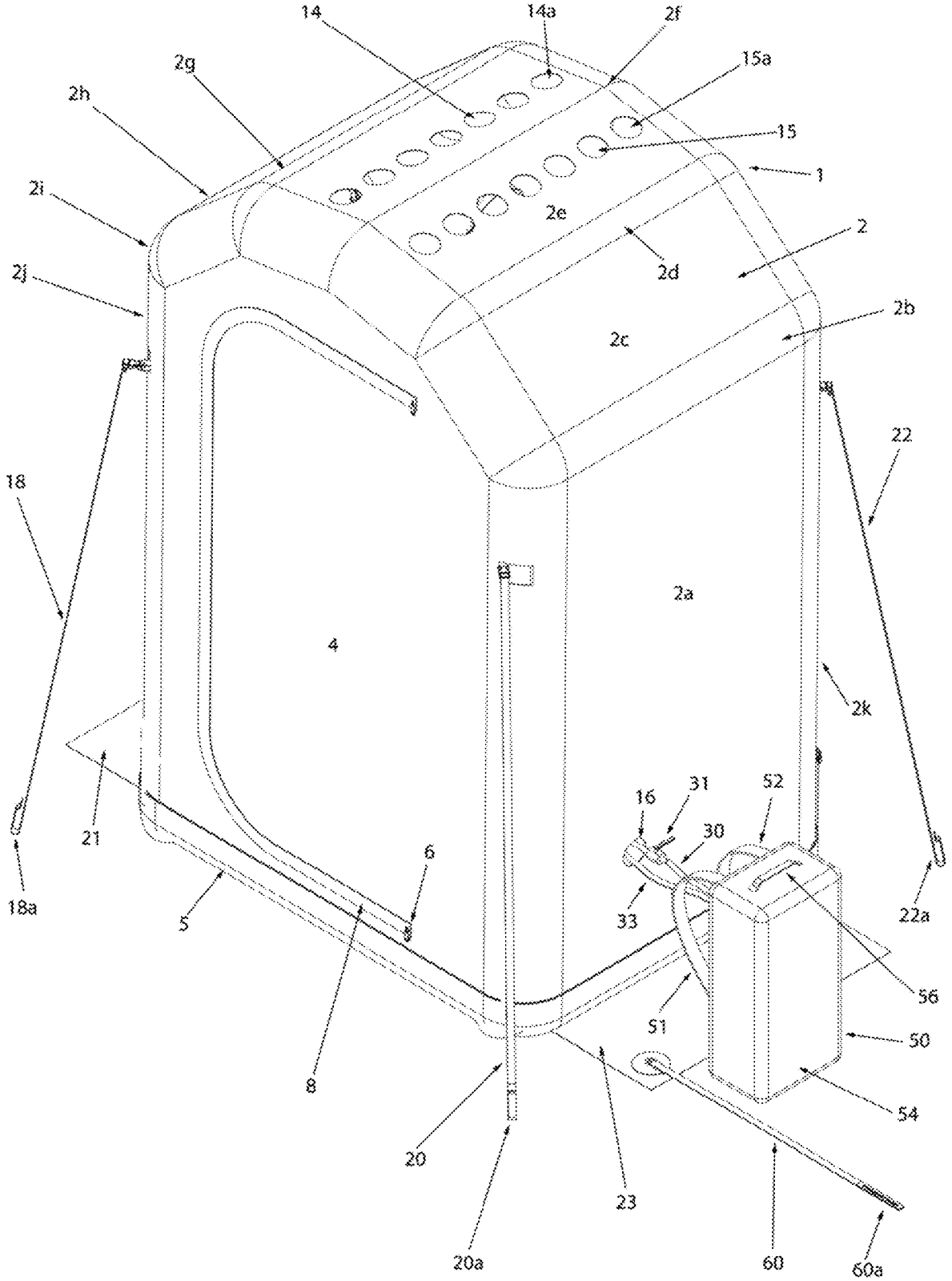
FIG. 1 shows a top, front, and right perspective view of an apparatus and a left side, rear, and top view of a backpack for storing the apparatus in accordance with an embodiment of the present invention, with the apparatus shown in an assembled state.

FIG. 1 shows a top, front, and right perspective view of an apparatus 1 and a left side, rear, and top view of a backpack 50 for storing the apparatus 1 in accordance with an embodiment of the present invention, with the apparatus 1 shown in an assembled state.

Figure 2:
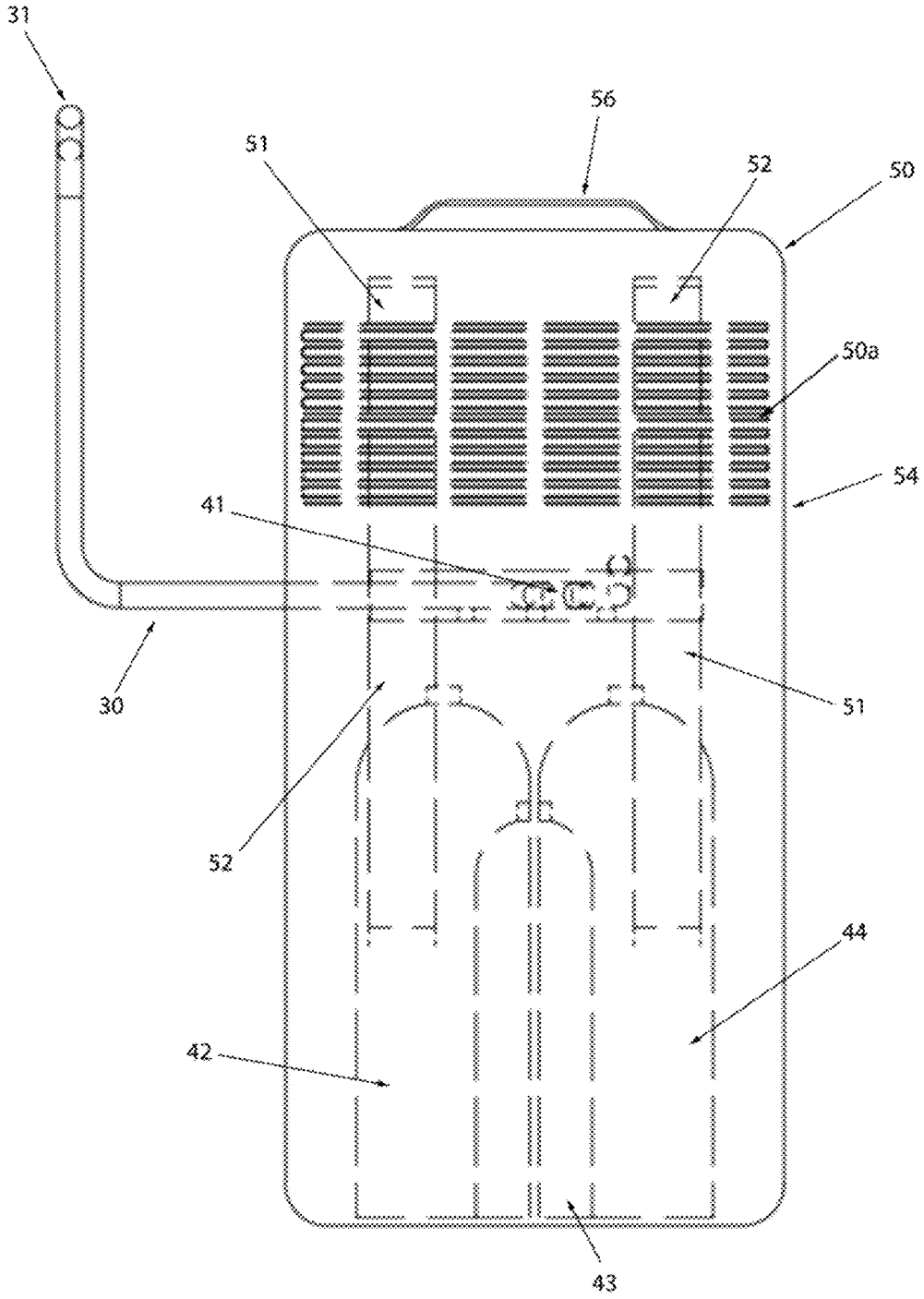
FIG. 2 shows a rear view of the backpack for use with the apparatus 1, with the backpack shown transparent, with three bottles, an inflatable device, and part of a first hose that are inside of the backpack shown in dashed lines.

FIG. 2 shows a rear view of the backpack 50 for use with the apparatus 1, with the backpack 50 shown transparent, with three bottles 42, 43, 44, a simplified representation of a inner region 50*a*, and part of a first hose 30 that are inside of the backpack 50 shown in dashed lines.

Figure 3:
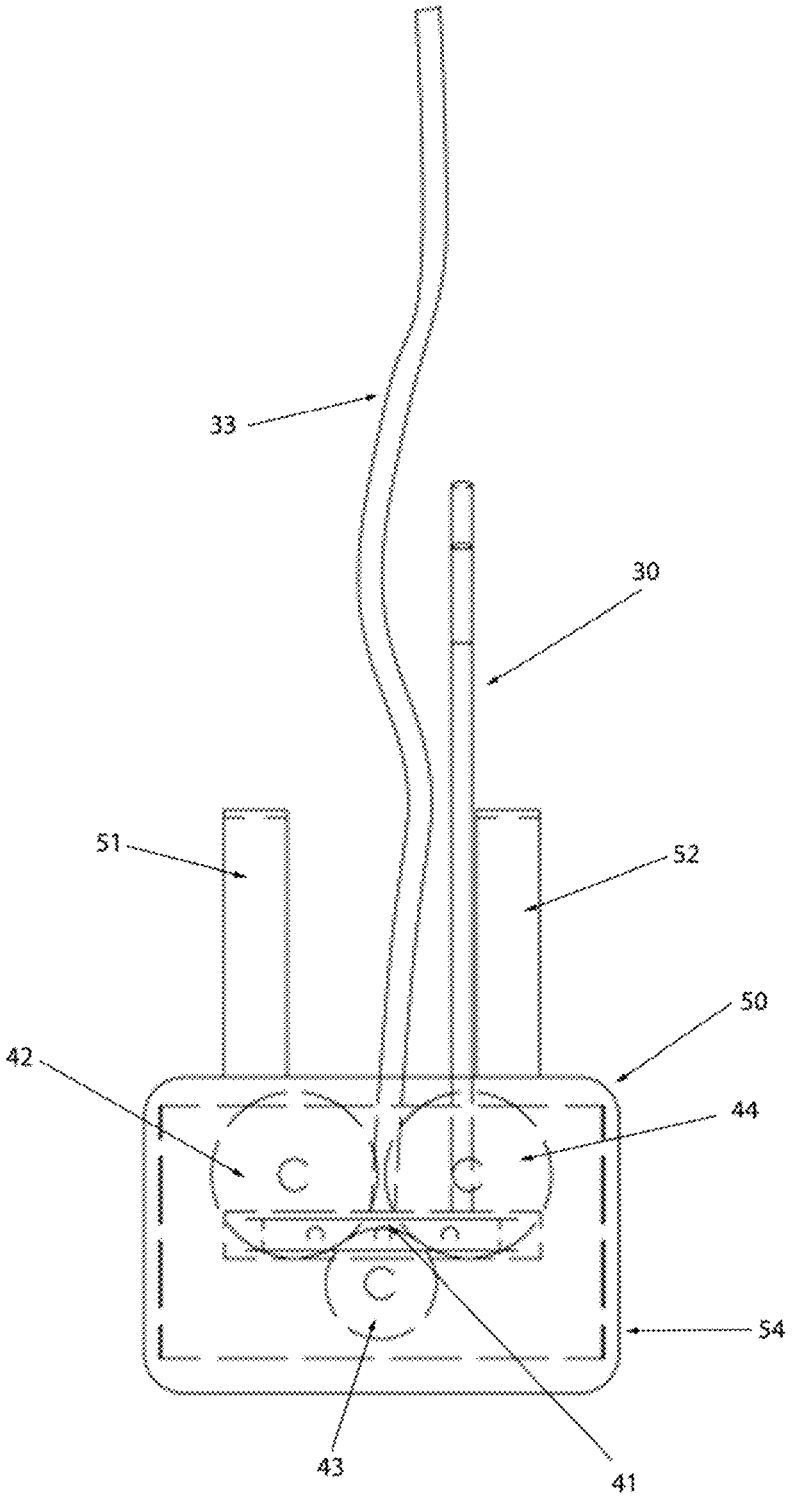
FIG. 3 shows a top view of the backpack, and the hose of FIG. 2, with the backpack shown as transparent.

FIG. 3 shows a top view of the backpack 50, and the hose 30 of FIG. 2, with the backpack shown 50 as transparent.

Figure 4:
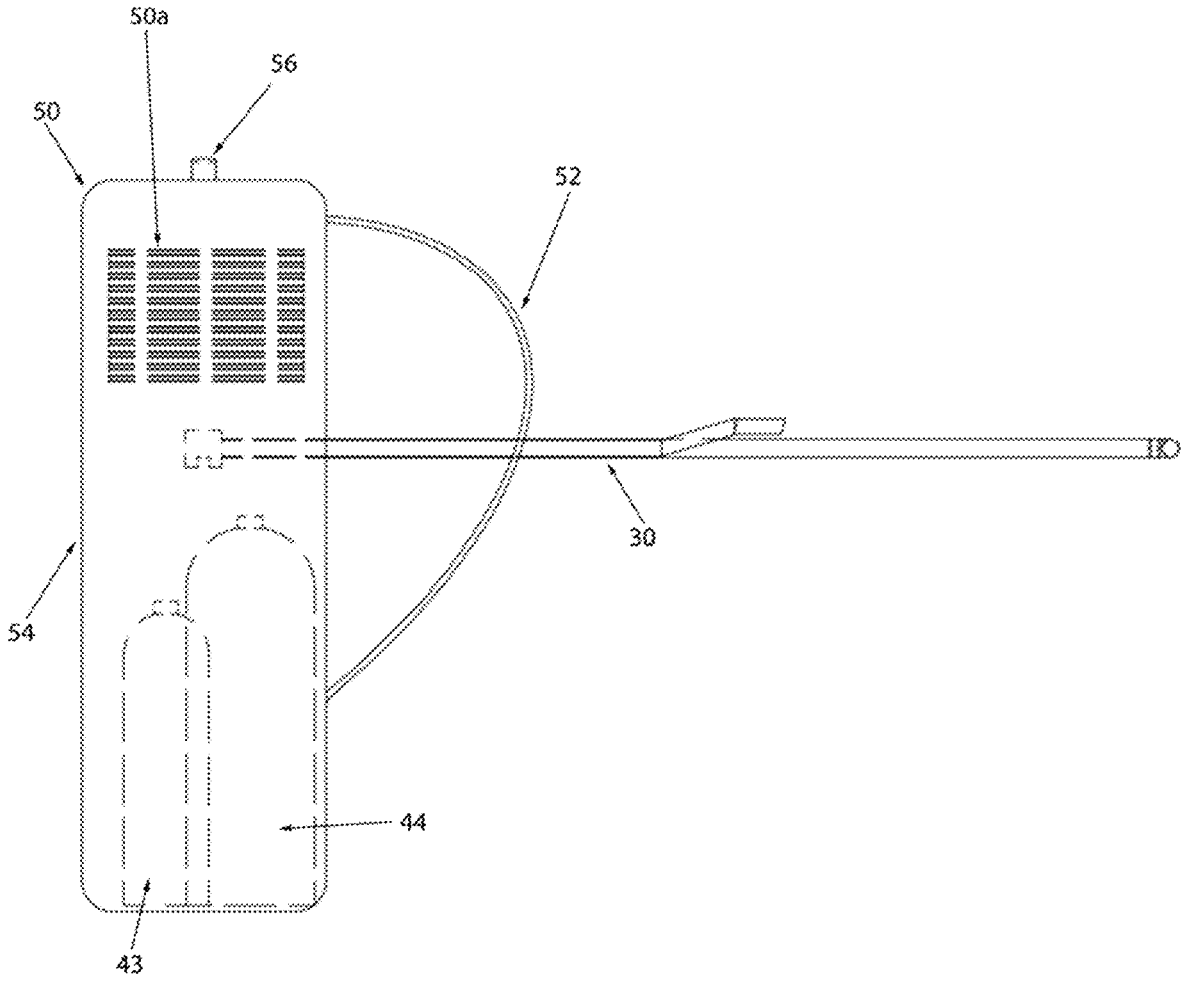
FIG. 4 shows a right side view of the backpack and the hose of FIG. 2, with the backpack shown as transparent.

FIG. 4 shows a right side view of the backpack 50, the inner region 50*a*, and the hose 30 of FIG. 2, with the backpack 50 shown as transparent.

Figure 5:
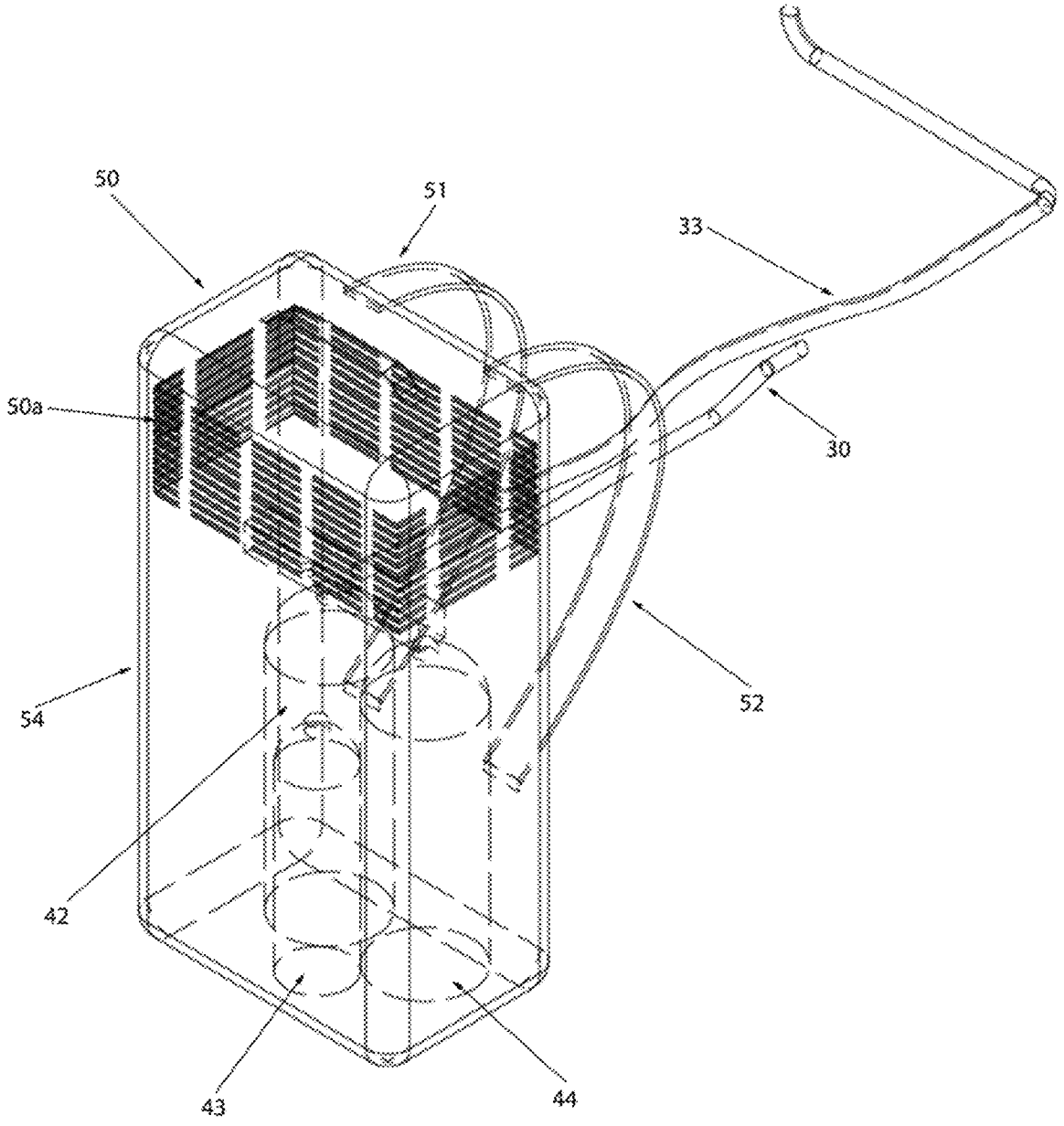
FIG. 5 shows a top, rear, and right side view of the backpack and the hose of FIG. 2, with the backpack shown as transparent, with the three bottles, and the inflatable device of FIG. 2 visible in dashed lines.
Figure 6:
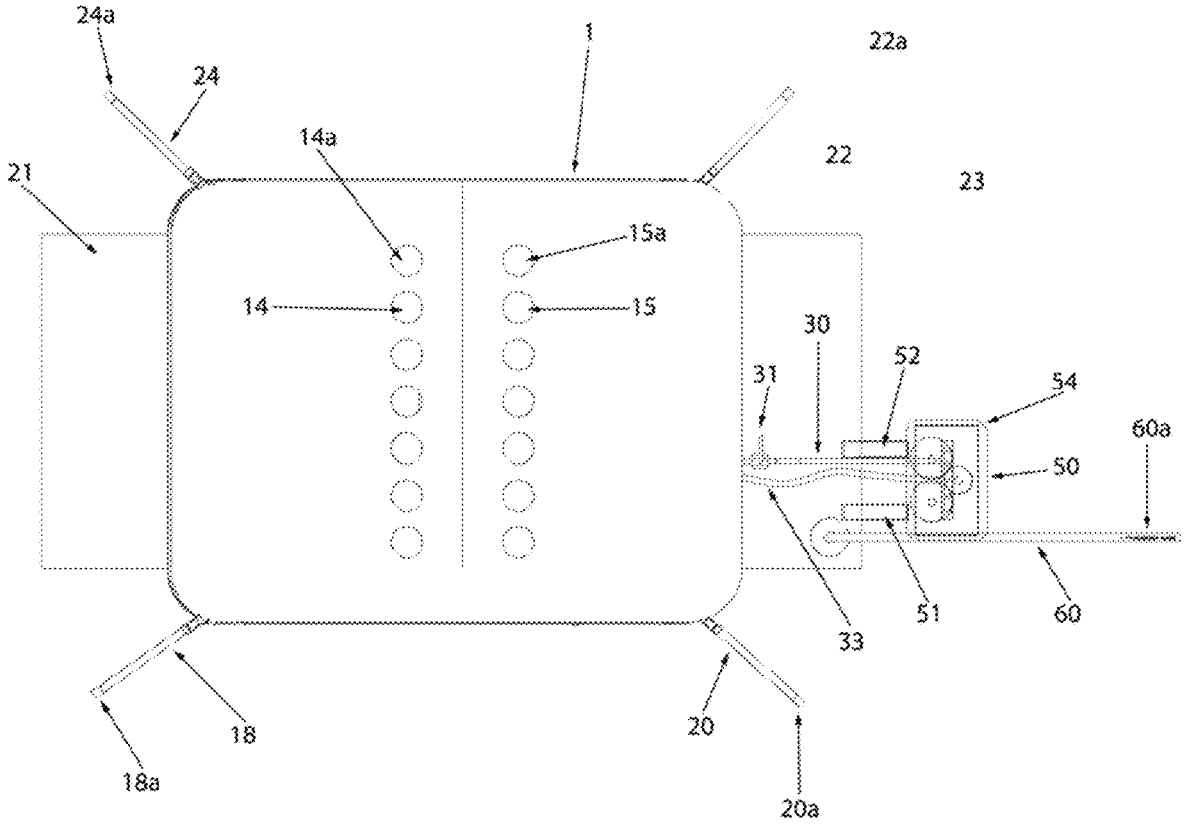
FIG. 6 shows a top view of the apparatus of FIG. 1 in the assembled state, and a top view of the backpack of FIG. 2.

FIG. 5 shows a top, rear, and right side view of the backpack 50 and the hose 30 of FIG. 2, with the backpack 50 shown as transparent, with the three bottles 42, 43, and 44, and the inner region 50*a* of FIG. 2 visible in dashed lines;

FIG. 6 shows a top view of the apparatus 1 of FIG. 1 in the assembled state, and a top view of the backpack 50 of FIG. 2.

Figure 7:
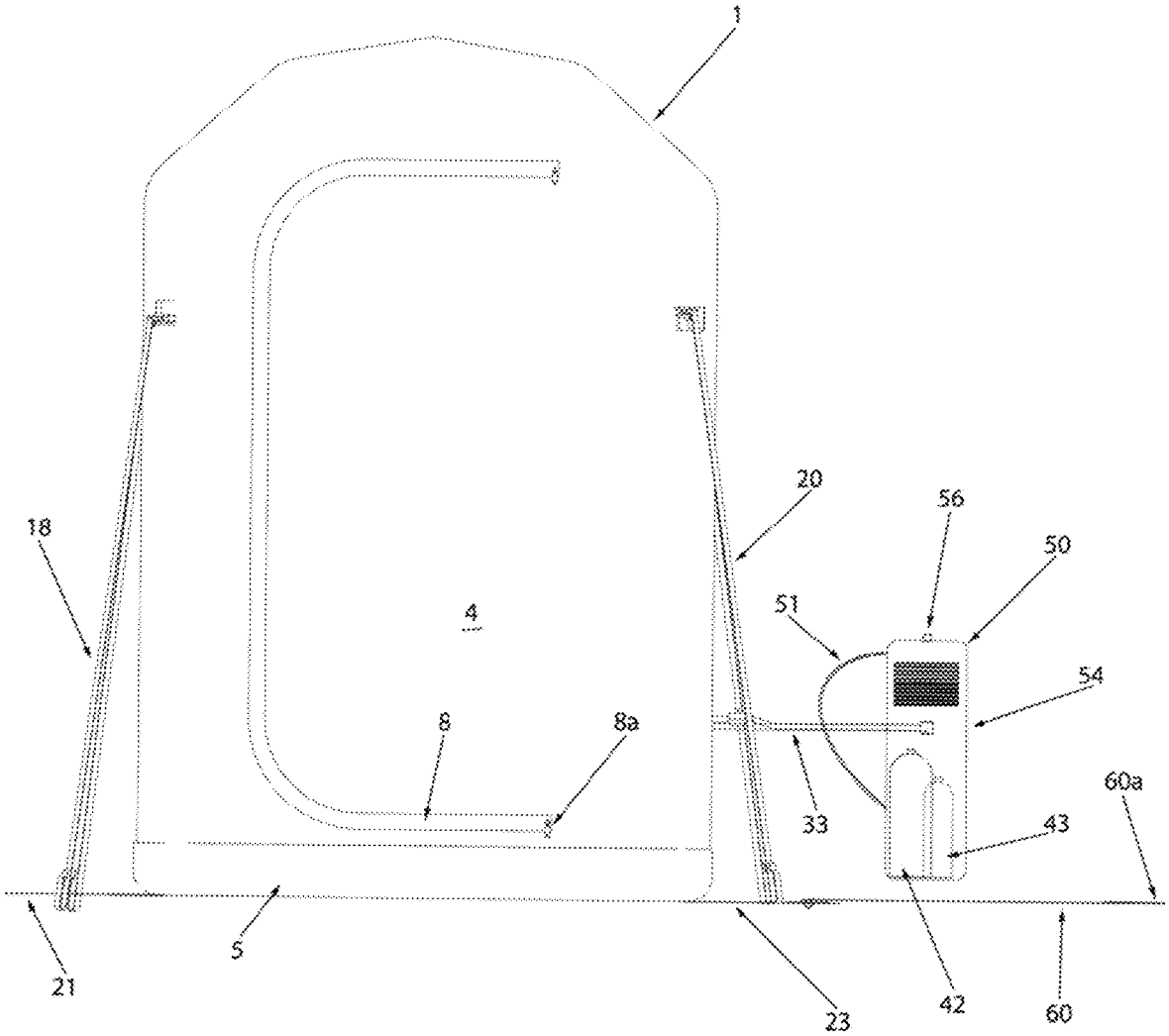
FIG. 7 shows a front view of the apparatus of FIG. 1 in the assembled state, and a left side view of the backpack of FIG. 2.

FIG. 7 shows a front view of the apparatus 1 of FIG. 1 in the assembled state, and a left side view of the backpack 50 of FIG. 2.

Figure 8:
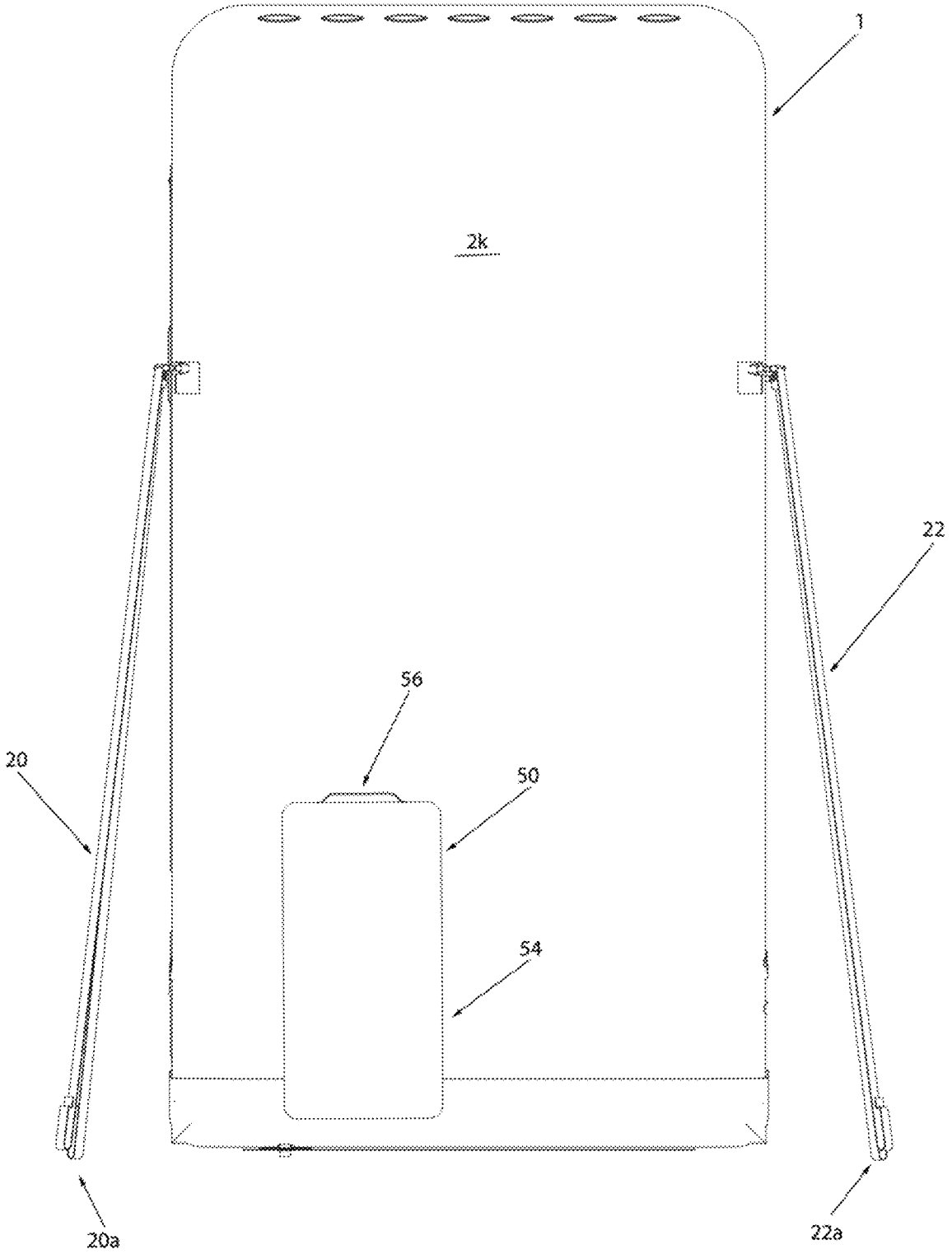
FIG. 8 shows a right side view of the apparatus of FIG. 1 in the assembled state, and a right rear view of the backpack of FIG. 2.
Figure 9:
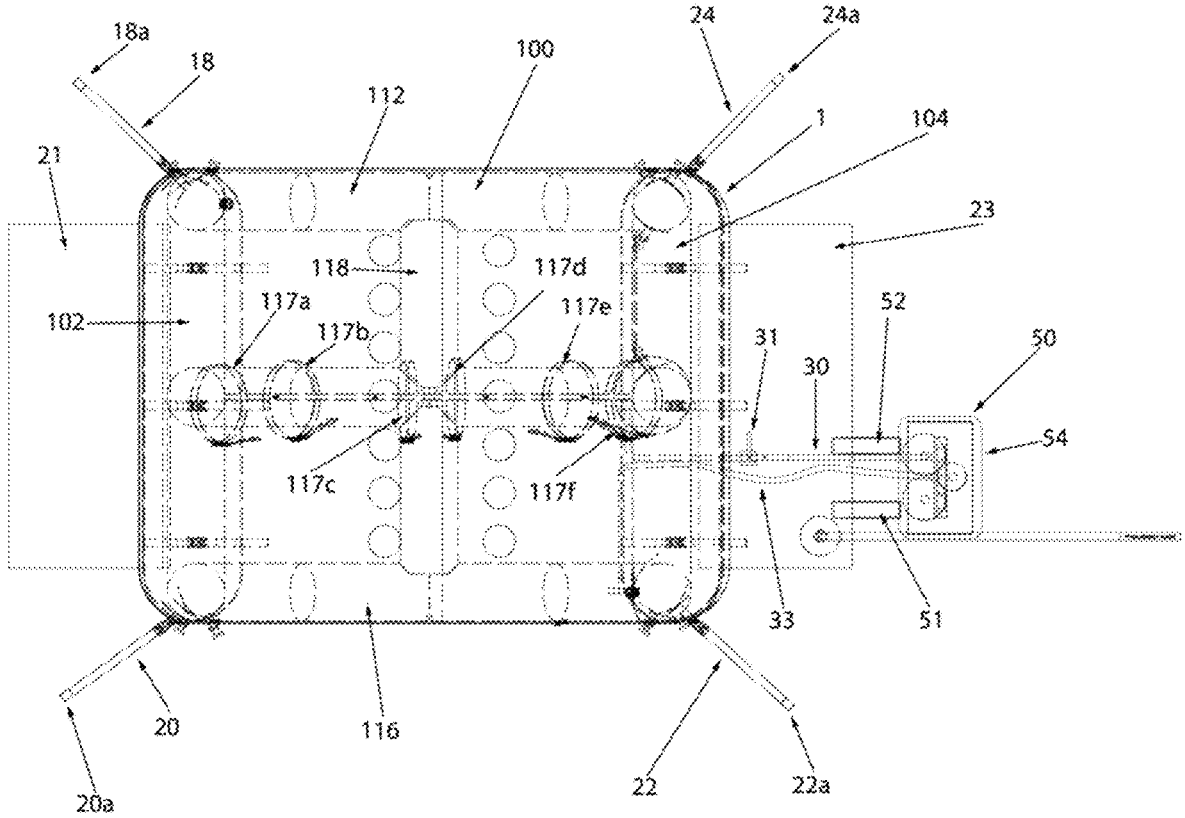
FIG. 9 shows a top view of the apparatus 1, in a transparent state, with an inflatable device or tube assembly, in assembled form, in dashed lines.

FIG. 8 shows a right side view of the apparatus 1 of FIG. 1 in the assembled state, and a right rear view of the backpack 50 of FIG. 2;

FIG. 9 shows a top view of the apparatus 1, in a transparent state, with an inflatable device or tube assembly 100, in assembled form, in dashed lines.

Figure 10:
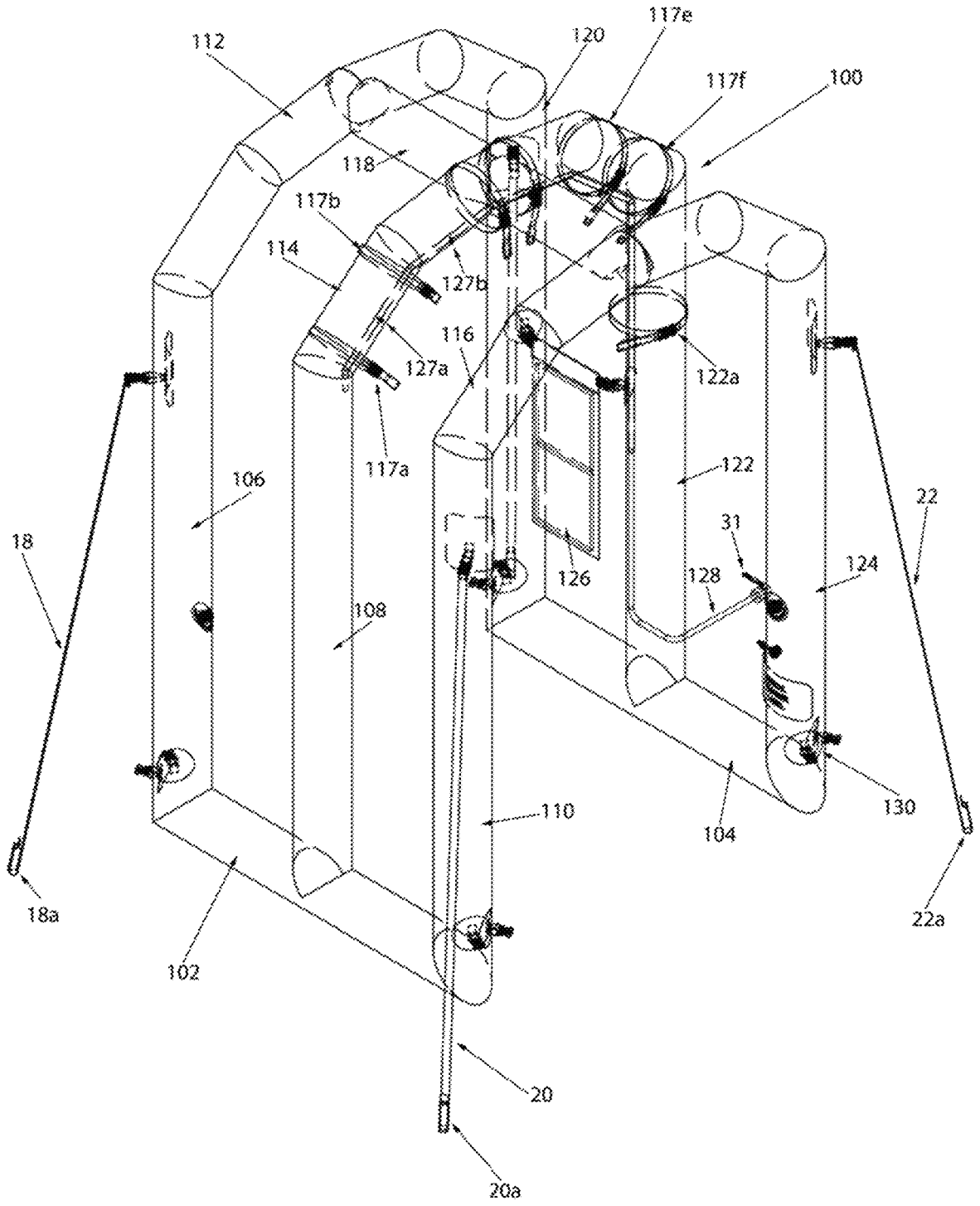
FIG. 10 shows a top, front, and right perspective view of the inflatable device or tube assembly in a fully inflated state for use with the apparatus in the assembled state shown in FIG. 1.

FIG. 10 shows a top, front, and right perspective view of the inflatable device or tube assembly 100 in a fully inflated state for use with the apparatus 1 in the assembled state shown in FIG. 1.

Figure 11:
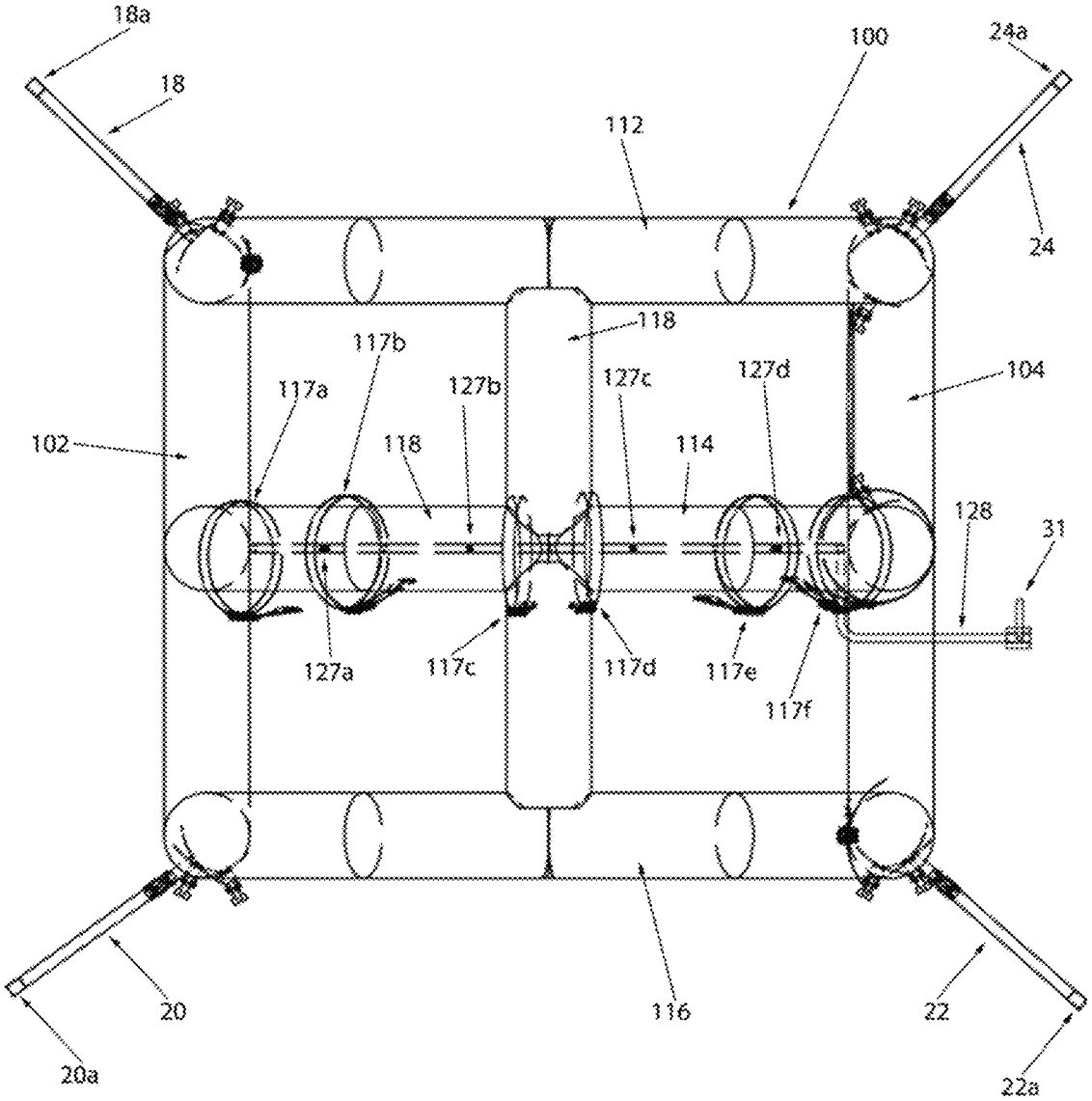
FIG. 11 shows a top view of the tube assembly of FIG. 10 in the fully inflated state.
Figure 12:
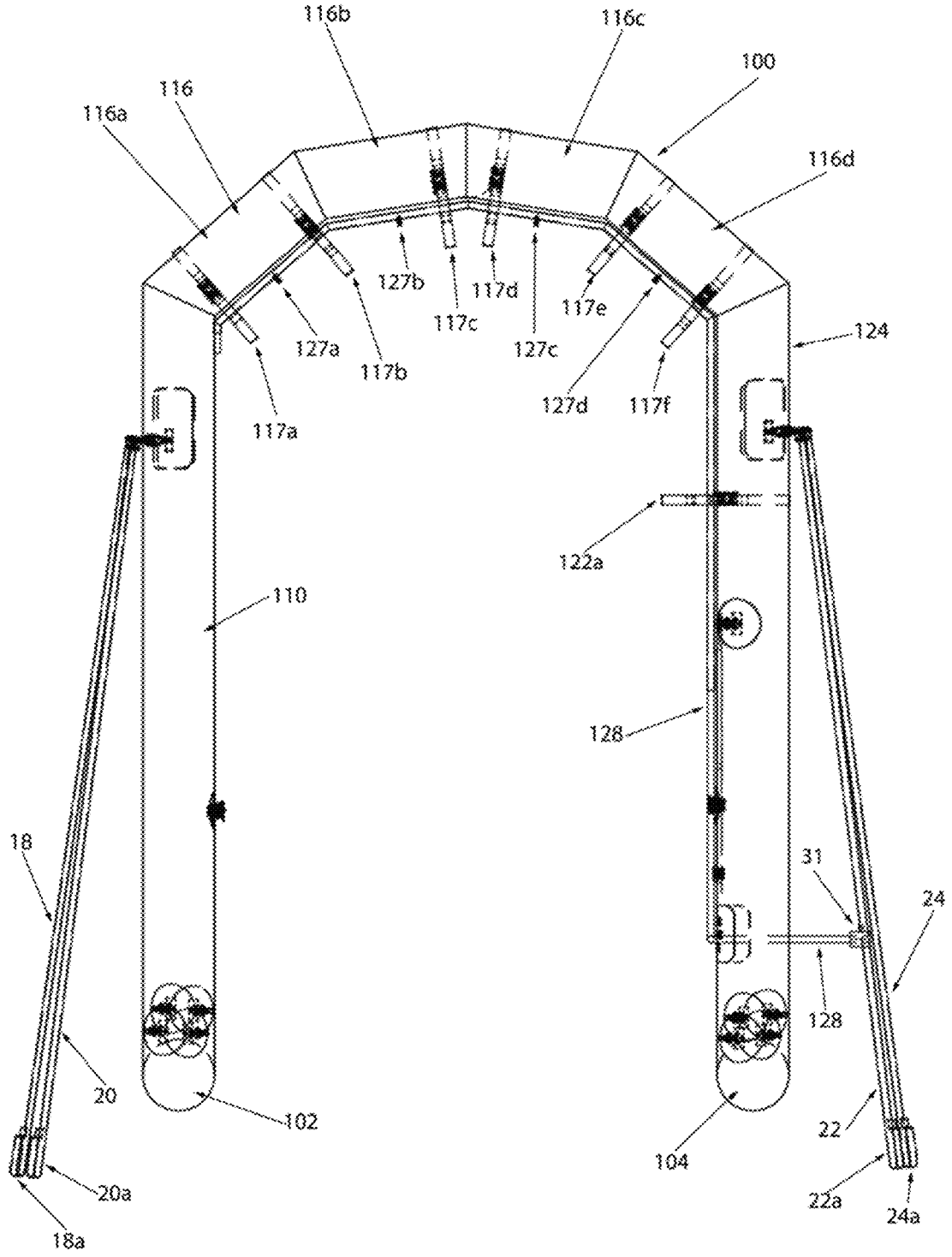
FIG. 12 shows a right side view of the tube assembly of FIG. 10 in the fully inflated state.
Figure 13:
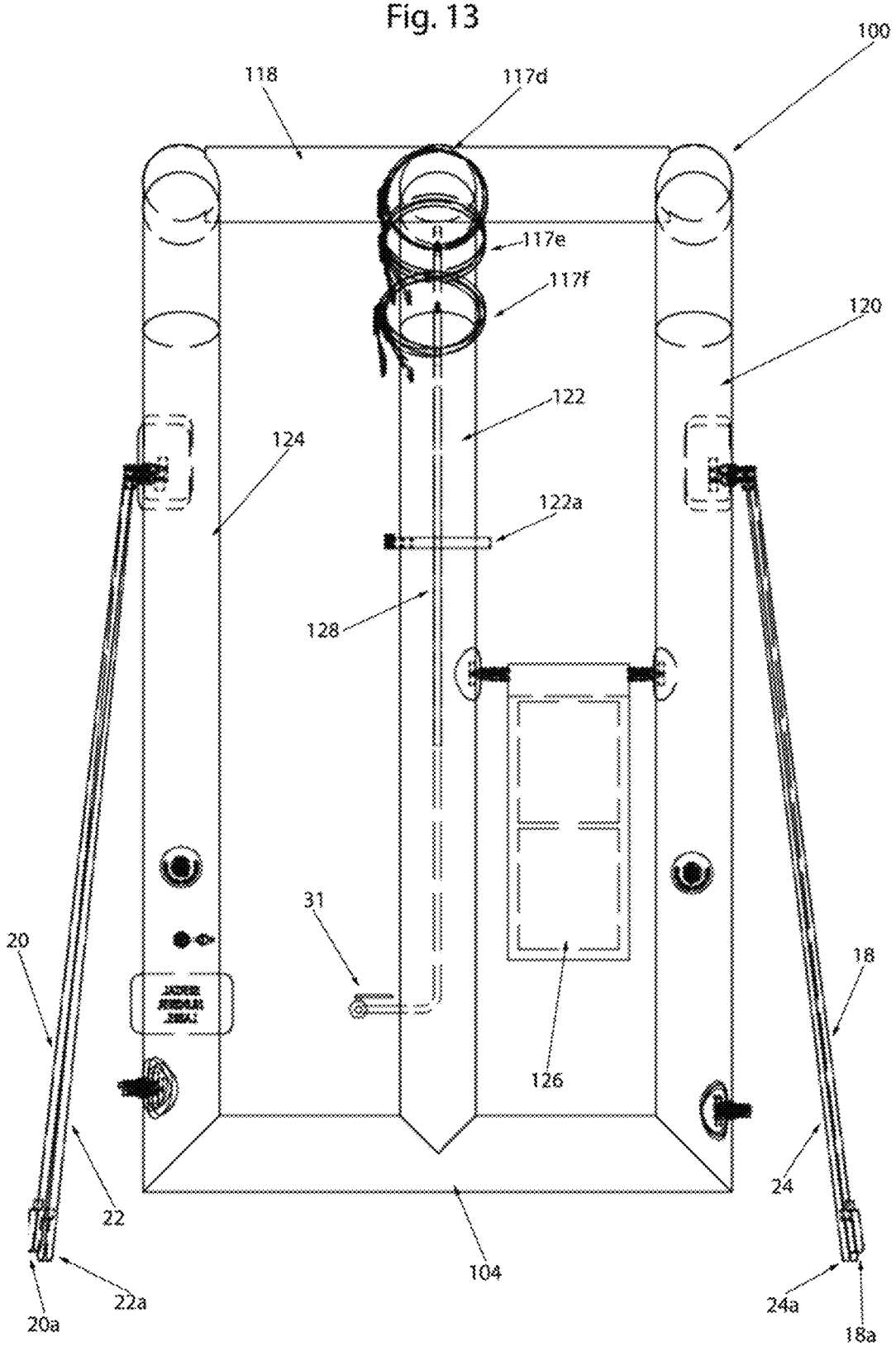
FIG. 13 shows a rear view of the tube assembly of FIG. 10 in the fully inflated state.

FIG. 11 shows a top view of the tube assembly 100 of FIG. 10 in the fully inflated state. FIG. 12 shows a right side view of the tube assembly 100 of FIG. 10 in the fully inflated state. FIG. 13 shows a rear view of the tube assembly 100 of FIG. 10 in the fully inflated state.

FIG. 12 shows a right side view of the tube assembly 100 of FIG. 10 in the fully inflated state.

FIG. 13 shows a rear view of the tube assembly 100 of FIG. 10 in the fully inflated state.

Referring to FIG. 1, the apparatus 1 includes a canopy 2, a door 4 attached to a peripheral surrounding region and/or floor/base material 5, a zipper 6, a zipper track 8, a plurality of ceiling vent holes 14 including hole 14*a*, and a plurality of ceiling vent holes 15, including hole 15*a*.

The apparatus 1 further includes cords 18, 20, 22, and 24 (cords 18, 20, 22 shown in FIG. 1, and cord 24 shown in FIG. 6). Each of the cords 18, 20, 22, and 24 have a first end which is attached to the canopy 2 or the tube assembly 100 and have a second end which is connected to a sandbag. Second ends or loops 18*a*, 20*a*, 22*a*, and 24*a* shown in FIG. 6, of cords 18, 20, 22, and 24 are attached to sandbags. Loops or second ends 18*a*, 20*a*, 22*a*, and 24*a* are typically connected to sandbags as needed.

The apparatus 1 further includes sides 21 and 23 and cord or strap 60 with Velcro (trademarked) and/or loops portion 60*a*, which also may include a label or name for the apparatus 1, shown in FIG. 1.

The canopy 2 includes portions 2*a*, 2*b*, 2*c*, 2*e*, 2*f*, 2*g*, 2*h*, 2*i*, 2*j*, and 2*k*, which are shown in FIG. 1, except for portion 2*k*, which is opposite the door 4. When the door 4 is closed by zipper 6 via zipper track 8, the canopy 2 provides a completely sealed or nearly completely sealed enclosed (via portions 2*a*-2*k*, door 4, and peripheral region or base material 5, and a bottom floor surface 5 in FIG. 1.

There is a side hose hole 16 through the portion 2*a* of the canopy 2.

The hose 30 provides both air inflation for the tube assembly 100 and water supply for a shower apparatus 128, shown in FIG. 10, by turning the valve 31, which may be a two way ball valve, shown in FIG. 1.

There is a second hose 33, which is an air hose for inflation, leading from the backpack 50 shown in FIG. 1.

The door 4, in at least one embodiment, is configured to be the single entry exit into the inner chamber enclosed by the canopy 2.

The loops 18*a*, 20*a*, 22*a*, and 24*a* shown in FIG. 6 are configured to be attached and/or integrated with the second ends of the cords 18, 20, 22, and 24, and then the loops or second ends 18*a*, 20*a*, 22*a*, and 24*a*, are connected to sandbags in order to hold the apparatus 1 to an outdoor ground surface to prevent the apparatus 1, and inflatable device or tube assembly 100 from blowing away in the wind.

The backpack 50 is configured to be able to hold the rest of the entire apparatus 1, as well as a water bottle 42, dry decon (decontamination) bottle 43, and air bottle 44. The backpack 50 has straps 51 and 52, for carrying the backpack 50, which are connected to a housing 54, in which the bottles 42, 43, and 44 are located. The backpack 50 includes a manifold/control 41, shown in FIGS. 2-3.

In at least one embodiment of the present invention water from the water bottle 42 is provided via the hose 30 (when valve 31 is in an open position), and then air is turned on from SCBA bottle 44. Air from bottle 44 forces water from the water bottle 42 to the shower assembly 128 shown in FIG. 10.

In FIGS. 2 and 4 the location or inner region 50*a* in which the apparatus 1 may be stored (not including the backpack 50), within the backpack 50 is shown. The apparatus 1, to be stored in inner region 50*a* may include canopy 2, tube assembly or inflatable device 100, shower assembly or hose 128, and misting nozzles 127*a*-*d*, clips 117*a*-*f*, and clip 122*a*.

In at least one embodiment, the bottle 44 is an SCBA air bottle; the bottle 43 is a dry decontamination bottle having 400.0 grams of pressure dry decontamination spray, to be used as a fast acting rapid solution for decontamination and absorption of toxic chemical vapors and liquids; and the bottle 42 is a water bottle. The enclosed housing 54 of the backpack 50 preferably is configured to contain the bottles 42-44.

In at least one embodiment, the canopy 2 is preferably made of a urethane coated ripstop material, wherein "ripstop" means a nylon fabric woven so that a tear will not spread. Typically "ripstop" may have threads woven every one quarter inch or thereabouts.

The tube assembly or inflatable device 100 is preferably made of a urethane coated nylon material.

In accordance with a method and/or apparatus of at least one embodiment of the present invention, the canopy 2 and the door 4 (in a folded and/or compacted state) is pulled out of the backpack 50 and the canopy 2 and the integrated door 4 and base material 5 are unfolded. The hose 33 is hooked from bottle 44 at side hose hole 16. Thereafter air is turned on by manifold control 41, shown in FIG. 2; and tube assembly 100 inflates in five seconds, which causes the canopy 2, the door 4, and base material 5, to be properly assembled as in FIG. 1.

Thereafter, water is activated by manifold 41, air is turned on to push water to shower 128 from water bottle 42 to misting shower components 127*a*, 127*b*, 127*c*, and 127*d*. In at least one embodiment, five minutes of shower time is provided.

The plurality of ceiling vent holes 14 and 15 are used to prevent the apparatus 1 from lifting up due to wind.

The backpack 50 is preferably configured to house an SCBA (self contained breathing apparatus) bottle 44, a water bottle 42, and a dry decontamination spray bottle 43.

In at least one embodiment, the apparatus 1 has a depth, D1, shown in FIG. 1, which may be about 54.7 5 inches, and a width W1 (not including the portions 21 and 23), shown in FIG. 1, which may be about sixty nine inches. The apparatus 1 may have a height from the top of the canopy 2 to the bottom of base area 5, which is attached to the door 4, of about 97.5 inches.

The weight of the entire apparatus 1, including the inflatable device or tube assembly 100 may be about twenty pounds.

The apparatus 1 may be described as an "inflatable backpack dry/shower decontamination shelter". In at least one embodiment, the apparatus 1 provides a five feet (width-horizontally, parallel to ground surface, across base material 5) by five feet (length-horizontally, parallel to ground surface across wall or portion 2*a*) by nine feet (height, from top of canopy 2 to bottom of canopy 2) shelter which is inflated using an SCBA (self contained breathing apparatus) bottle 44 within five seconds.

The apparatus 1 offers both a dry decontamination spray and a wet shower option. In at least one embodiment, dry decontamination spray is picked up and manually sprayed from head to toe using an aerosol can. All bottles 42-44 are stored inside the backpack 50 and in at least one embodiment, are stored using laser cut foam which is installed in the bottom of the backpack 50.

The inflatable shelter air beams of support structure or inflatable device 100 shown in FIGS. 9-13, are preferably comprised of a urethane coated nylon. The outer shell or canopy 2 is preferably urethane coated ripstop (parachute material) which is lightweight, durable and flame resistant. The floor of the apparatus 1 (number of floor in FIG. 1, or show diagram of floor 5) is preferably comprised of eighteen ounce PVC (poly vinyl chloride) and serves as a containment area to prevent runoff. When folded, the shelter or apparatus 1 fits into the backpack 50, making this the smallest decontamination shelter ever made.

The total package weight of the apparatus 1, in at least one embodiment, is less than fifty-five pounds.

The apparatus 1 gives the end user the first ever inflatable backpack dry/shower decontamination shelter that can be used for a single person decontamination within seconds. This will save lives and prevent the spread of contaminants.

FIG. 10 shows a top, front, and right perspective view of a support structure or tube assembly or inflatable device 100, which may be part of the apparatus 1 of FIG. 1, in accordance with an embodiment of the present invention, with the support structure 100 shown a blown up or fully inflated state.

The support structure 100 may be comprised of a plurality of interconnected inflatable tubes, such as including vertical tubes 106, 108, 110, 120, 122, and 124, horizontal or floor tubes 102 and 104, arc tubes 112, 114, and 116, and cross tube 118. In at least one embodiment, the support structure or inflatable device 100 may be inflated through air coming through hose 33, and after the support structure 100 is inflated, the canopy 2 may be placed over the support structure 100.

In at least one embodiment, the canopy 2 may be preinstalled on the support structure 100.

FIG. 10 shows a top, front, and right perspective view of a tube assembly or support structure 100 in a fully inflated state for use with the apparatus 1 in the assembled state shown in FIG. 1.

No power is needed for the assembly and operation of the apparatus 1.

In operation, the apparatus 1 including the canopy 2 and the tube assembly 100, typically in a completely deflated or nearly completely deflated state are pulled from region 50*a* out of the interior or inner chamber within the housing 54 of the backpack 50. The tube assembly 100 is not shown in FIG. 1, but provides structure support for and is within the canopy 2 in the assembled state of FIG. 1.

A first end of the hose 33 is attached to the inflation valve or air valve 31*a* shown in FIG. 1. The air is turned on using the manifold 41 shown in FIG. 2 near top of bottles 42-44 inside of housing 54 of backpack 50. Inflation of the tube assembly 100 due to air from bottle 44 (SCBA bottle) takes about five to seven seconds. A second end of the hose 30 opposing the first end 31 is connected to shower assembly 128 shown in FIG. 10. Water is turned on using the manifold 41 shown in FIG. 2. Air is turned on using the manifold 41, air forces water from water bottle 42 to misting shower heads 127*a*, 127*b*, 127*c*, and 127*d* and the shower can be used for typically five minutes.

As shown in FIG. 12, the arc tube 116 includes portions 116*a*, 116*b*, 116*c*, and 116*d*. FIG. 12 also shows hose or pipe 128 which is connected to valve 31 which is connected to hose or pipe 30 shown in FIG. 1. Hose, pipe or shower device 128, shown in FIG. 12, is connected to misting nozzles 127*a*, 127*b*, 127*c*, and 127*d*. In operation, water or air from hose or pipe 30, goes through valve 31 (when valve is in an open state), into hose or pipe 128, and comes out misting nozzles 127*a-d*.

FIG. 12 also shows clips 117*a*, 117*b*, 117*c*, 117*d*, 117*e*, 117*f*, and 122*a*, for holding the pipe or hose 128, and nozzles 127*a-d* (which are connected to pipe or hose 128) to the tube assembly 100. More specifically, as shown by FIG. 10, the pipe 128 is held by clip 122*a* to portion or tube 122, and the pipe is held by clips 117*a-f* to central arc tube 114.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

an inflatable tube assembly;

a shower assembly; configured to be attached to the inflatable tube assembly when the inflatable tube assembly is in an inflated state;

a canopy configured to cover the inflatable tube assembly, when the inflatable tube assembly is in the inflated state;

a first bottle for inflating the inflatable tube assembly;

a second bottle, which is a water bottle;

a manifold; and a backpack configured to hold the inflatable tube assembly in a deflated state, simultaneously with the first bottle, the second bottle, and the manifold;

wherein the manifold is configured to direct air from the first bottle to inflate the inflatable tube assembly; and wherein the manifold is configured to direct water from the second bottle to the shower assembly.

2. The apparatus of claim 1 further comprising a third bottle; and wherein the backpack is configured to hold the third bottle, simultaneously with the first bottle, the second bottle, the manifold, and the inflatable tube assembly in the deflated state; and wherein the third bottle includes a decontamination material.

3. The apparatus of claim 1 wherein the manifold is configured to direct air from the first bottle to inflate the inflatable tube assembly, while the first bottle, the second bottle, and the manifold are in the backpack; and wherein the manifold is configured to direct water from the second bottle to the shower assembly, while the first bottle, the second bottle, and the manifold are in the backpack.

4. The apparatus of claim 1 wherein the manifold is configured to direct air from the first bottle into the second bottle and to direct water out of the second bottle.

5. The apparatus of claim 1 wherein the backpack is configured to hold the inflatable tube assembly in a deflated state, simultaneously with the first bottle, the second bottle, the manifold, the canopy, and the shower assembly.

6. The apparatus of claim 1 wherein the first and second bottles are stored in a bottom of the backpack;

wherein a region is provided in the backpack above the first and second bottles; and wherein the manifold, and the inflatable tube assembly in the deflated state are configured to be simultaneously located in the region, while the first and second bottles are stored in the bottom of the backpack.

7. The apparatus of claim 1 wherein the manifold is configured to permit a flow of air from the first bottle to inflate the inflatable tube assembly;

wherein the manifold is configured to permit a flow of water from the second bottle to the shower assembly; and wherein the manifold is configured to direct a flow of air from the first bottle to the second bottle to force water to the shower assembly.

8. A method comprising inflating an inflatable tube assembly by using a first bottle;

attaching a shower assembly to the inflatable tube assembly when the inflatable tube assembly is in the inflated state; and covering the inflatable tube assembly with a canopy, when the inflatable tube assembly is in the inflated state;

wherein the inflatable tube assembly is inflated by using a manifold; and further comprising using the manifold to supply water to the shower assembly.

9. The method of claim 8 further comprising removing the inflatable tube assembly from a backpack, when the inflatable tube assembly is in a deflated state, prior to inflating the inflatable tube assembly;

and wherein the backpack includes the first bottle, and a second bottle;

wherein the second bottle is a water bottle; and wherein the manifold is used to supply water from the second bottle to the shower assembly.

10. The method of claim 9 further comprising removing the first bottle from the backpack prior to inflating the inflatable tube assembly.

11. The method of claim 9 wherein the manifold is used to cause air from the first bottle to inflate the inflatable tube assembly, while the first bottle, the second bottle, and the manifold are in the backpack; and wherein the manifold is used to cause water to be supplied from the second bottle to the shower assembly, while the first bottle, the second bottle, and the manifold are in the backpack.

12. The method of claim 9 wherein the step of removing the inflatable tube assembly from the backpack, when the inflatable tube assembly is in the deflated state, includes removing the inflatable tube assembly, the shower assembly, and the canopy out from a region of the backpack, while the first and second bottles are in another region of the backpack.

13. The method of claim 9 wherein the manifold is configured to permit a flow of air from the first bottle to inflate the inflatable tube assembly;

wherein the manifold is configured to permit a flow of water from the second bottle to the shower assembly; and wherein the manifold is configured to permit a flow of air from the first bottle to the second bottle to force water to the shower assembly.

14. The method of claim 9 further comprising removing the second bottle from the backpack prior to inflating the inflatable tube assembly, and using the second bottle to supply water to the shower assembly after the shower assembly is attached to the inflatable tube assembly when the inflatable tube assembly is in the inflated state.

15. The method of claim 14 further comprising removing the first bottle from the backpack prior to inflating the inflatable tube assembly, and using the manifold to cause the first bottle to force water from the second bottle to be supplied to the shower assembly after the shower assembly is attached to the inflatable tube assembly when the inflatable tube assembly is in the inflated state.

* * * * *